US009336936B1

(12) United States Patent
Smith

(10) Patent No.: US 9,336,936 B1
(45) Date of Patent: May 10, 2016

(54) MAGNETIC PATHWAY CLEANING ASSEMBLIES AND VEHICLES INCORPORATING THE SAME

(71) Applicant: Toyota Motor Engineering & Manufacturing North America, Inc., Erlanger, KY (US)

(72) Inventor: Aaron Smith, Carmi, IL (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 14/797,467

(22) Filed: Jul. 13, 2015

(51) Int. Cl.
*B61F 19/00* (2006.01)
*H01F 7/02* (2006.01)

(52) U.S. Cl.
CPC ..... *H01F 7/0257* (2013.01)

(58) Field of Classification Search
CPC ..... H01F 7/0257
USPC ..... 104/279
See application file for complete search history.

(56) References Cited

U.S. PATENT DOCUMENTS 3,249,211 A 5/1966 Gray
3,401,365 A * 9/1968 Grader ..... B66C 7/00 104/279
3,517,787 A * 6/1970 Dean ..... E01H 8/10 104/279
3,533,121 A * 10/1970 Kershaw ..... E01B 27/026 104/279
3,731,455 A 5/1973 Theurer
4,225,429 A * 9/1980 Holley ..... B03C 1/16 104/279
5,060,335 A * 10/1991 Webster ..... E01H 8/10 104/279
5,307,744 A * 5/1994 Newman ..... B03C 1/035 105/238.1
5,437,232 A * 8/1995 Borowski ..... E01B 27/02 104/2
5,481,983 A * 1/1996 Guzman ..... B03C 1/30 104/279
5,695,574 A * 12/1997 Falardeau ..... E01H 8/00 104/279
6,154,920 A * 12/2000 Petrole ..... A47L 11/24 15/349
6,758,145 B1 * 7/2004 Hefter ..... A63H 19/15 104/279
7,926,426 B2 * 4/2011 Sperling ..... E01B 29/32 104/2
8,371,229 B1 * 2/2013 Sailor ..... E01H 8/00 104/279
2006/0196386 A1 * 9/2006 Mull ..... A63H 19/15 104/279
2007/0039514 A1 * 2/2007 Godard ..... E01H 8/12 104/279
2008/0216702 A1 * 9/2008 Leonowicz ..... E01B 31/02 104/279
2010/0258026 A1 * 10/2010 Kanemori ..... E01H 8/04 104/279
2012/0222580 A1 * 9/2012 Grammatis ..... E01H 8/06 104/279
2015/0053109 A1 * 2/2015 Bramlett ..... E01H 8/105 104/279
2015/0345089 A1 * 12/2015 Doerr ..... E01H 8/10 104/279

FOREIGN PATENT DOCUMENTS

WO 0058186 10/2000

OTHER PUBLICATIONS

Hang Type Magnetic Sweeper; http://www.globalindustrial.com/g/janitorial-maintenance/floor-care/sweepers-magnetic/hang-type-magnetic-sweeper. Date of access: Apr. 30, 2015.

* cited by examiner

*Primary Examiner* — Jason C Smith
(74) *Attorney, Agent, or Firm* — Dinsmore & Shohl LLP

(57) ABSTRACT

Embodiments of a magnetic pathway cleaning assembly include a magnet having a pathway facing surface and a magnet sweeper having a sweeping portion that is slidably engageable with the pathway facing surface of the magnet and a translation shaft having a first end opposite a second end. The first end is coupled to the sweeping portion and the second end terminates at a contact surface. A spring is engaged with the translation shaft such that the spring biases the magnet sweeper into a retracted position offset from the pathway facing surface of the magnet. Further, the magnet sweeper is actuatable such that a force applied to the contact surface of the translation shaft moves the sweeping portion along the pathway facing surface of the magnet.

20 Claims, 4 Drawing Sheets

MAGNETIC PATHWAY CLEANING ASSEMBLIES AND VEHICLES INCORPORATING THE SAME

TECHNICAL FIELD

The present disclosure is generally directed to magnetic pathway cleaning assemblies and vehicles that include magnetic pathway cleaning assemblies.

BACKGROUND

Vehicles are used in factory environments to assist with inventory management by transporting parts from one area of the factory to another along a vehicle pathway. For example, parts may be loaded on a vehicle in a staging area. Once the parts are loaded, the vehicle may drive along the vehicle pathway to an assembly area where the parts are unloaded and used in an assembly processes.

However, debris may accumulate on the vehicle pathway. Contact between debris and vehicles may damage the vehicles and the vehicle pathway and disrupt operation of the vehicles. Accordingly, cleaning systems for vehicle pathways are desired.

SUMMARY

In one embodiment, a magnetic pathway cleaning assembly includes a magnet having a pathway facing surface and a magnet sweeper including a sweeping portion slidably engageable with the pathway facing surface of the magnet and a translation shaft having a first end opposite a second end. The first end is coupled to the sweeping portion and the second end terminates at a contact surface. A spring is engaged with the translation shaft such that the spring biases the magnet sweeper into a retracted position offset from the pathway facing surface of the magnet. Further, the magnet sweeper is actuatable such that a force applied to the contact surface of the translation shaft moves the sweeping portion along the pathway facing surface of the magnet.

In another embodiment, a vehicle includes a vehicle frame and a wheel coupled to an underside of the vehicle frame and a magnetic pathway cleaning assembly including a magnet coupled to the underside of the vehicle frame, the magnet having a pathway facing surface. The magnetic pathway cleaning assembly further includes a magnet sweeper having a sweeping portion slidably engageable with the pathway facing surface of the magnet and a translation shaft having a first end opposite a second end. The first end is coupled to the sweeping portion and the second end terminates at a contact surface positioned beyond the vehicle frame. A spring is engaged with the translation shaft such that the spring biases the magnet sweeper into a retracted position offset from the pathway facing surface of the magnet. Further, the magnet sweeper is actuatable such that a force applied to the contact surface of the translation shaft moves the sweeping portion along the pathway facing surface of the magnet.

In yet another embodiment, a method of cleaning a vehicle pathway includes traversing a vehicle along a portion of a vehicle pathway, the vehicle having a vehicle frame, a wheel coupled to an underside of the vehicle frame, and a magnetic pathway cleaning assembly coupled to the underside of the vehicle frame. The magnetic pathway cleaning assembly includes a magnet having a pathway facing surface and a magnet sweeper including a sweeping portion slidably engageable with the pathway facing surface of the magnet and a translation shaft having a first end opposite a second end. The first end is coupled to the sweeping portion and the second end terminates at a contact surface positioned beyond the vehicle frame. A spring is engaged with the translation shaft such that the spring biases the sweeping portion into a retracted position offset from the pathway facing surface of the magnet. The method further includes traversing a portion of a vehicle pathway with the magnet sweeper in the retracted position and applying a force to the contact surface of the translation shaft such that the sweeping portion slides along the pathway facing surface of the magnet.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments of the present disclosure are directed to pathway cleaning systems that include magnetic pathway cleaning assemblies, vehicles comprising magnetic pathway cleaning assemblies, and methods of using magnetic pathway cleaning assemblies. The vehicle, for example, a conveyor skillet, is configured to travel along a vehicle pathway, for example, along one or more guide rails positioned on a facility floor. The magnetic pathway cleaning assembly may be coupled to the vehicle and may extend toward the vehicle pathway. The magnetic pathway cleaning assembly includes a magnet for attracting magnetic debris located on the vehicle pathway, a magnet sweeper including a sweeping portion configured to slide along a pathway facing surface of the magnet to remove debris accumulated by the magnet, and one or more catch pans positioned offset from the magnet such that the magnet sweeper may push the accumulated magnetic debris into the one or more catch pans. The magnet sweeper also includes a translation shaft coupled to the sweeping portion. A spring biases the sweeping portion into a retracted position, offset from the pathway facing surface of the magnet. In operation, when force is applied to the translation shaft, the sweeping portion slides along the pathway facing surface of the magnet to push any debris accumulated by the magnet into the one or more catch pans and when force is removed from the translation shaft, the spring returns the magnet sweeper into the retracted position offset from the pathway facing surface of the magnet. Various embodiments of magnetic pathway cleaning assemblies, vehicles comprising the same, and methods of using the same will be described in further detail herein with specific reference to the appended drawings.

As used herein, the term "longitudinal direction" refers to the forward-rearward direction of the magnetic pathway cleaning assembly and the vehicle (i.e., in the +/−X-direction as depicted). The term "lateral direction" refers to the cross-direction of the magnetic pathway cleaning assembly and the vehicle (i.e., in the +/−Y-direction as depicted), and is transverse to the longitudinal direction. The term "vertical direction" refers to the upward-downward direction of the magnetic pathway cleaning assembly and the vehicle (i.e., in the +/−Z-direction as depicted), and is transverse to the lateral and the longitudinal directions.

Figure 1:
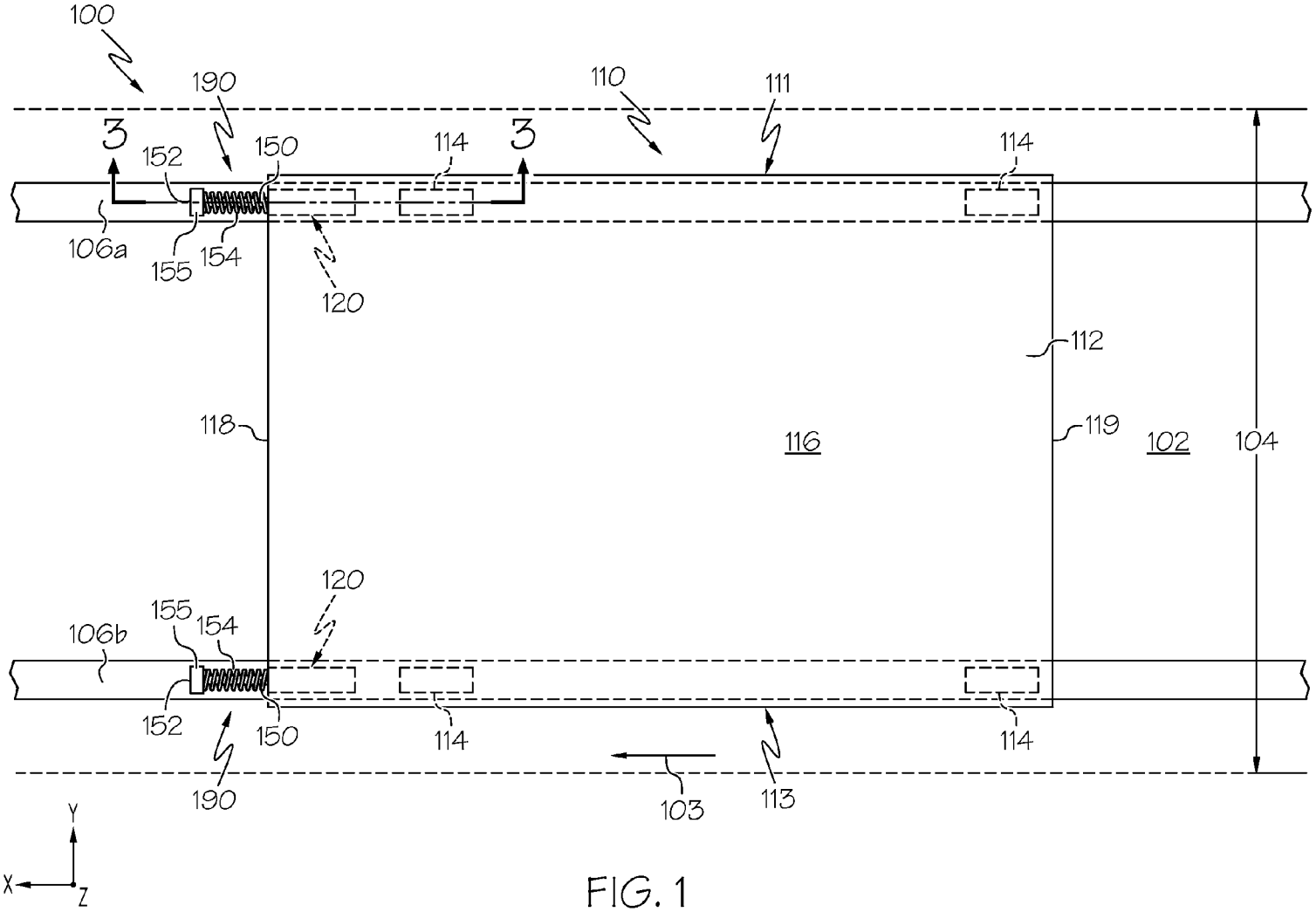
FIG. 1 depicts a schematic top view of the a pathway cleaning system including a vehicle having a magnetic pathway cleaning assembly according to one or more embodiments described herein.
Figure 2:
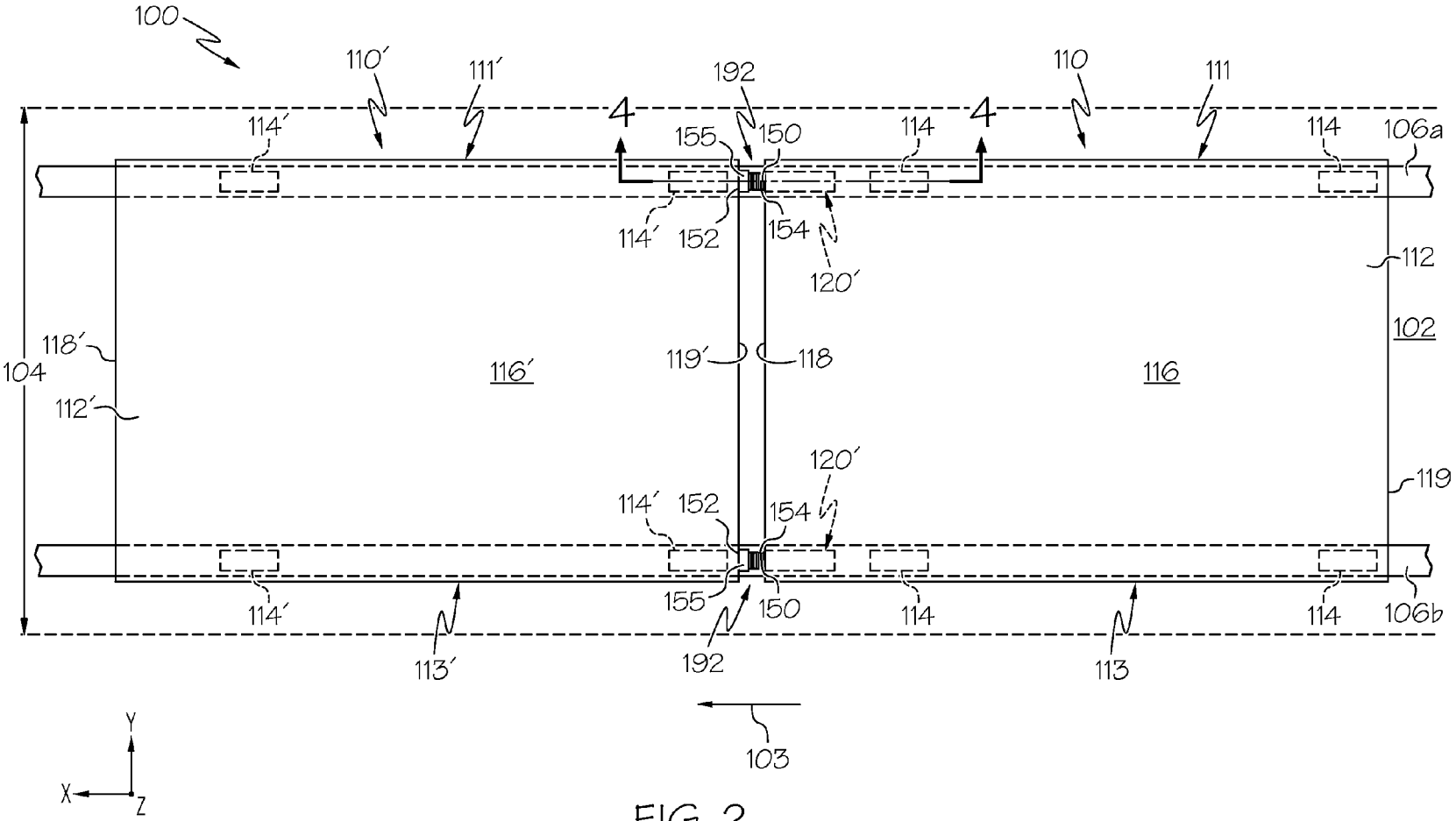
FIG. 2 depicts a schematic top view of a pathway cleaning system including two vehicles, one vehicle having a magnetic pathway cleaning assembly according to one or more embodiments described herein.

Referring now to FIGS. 1 and 2, a pathway cleaning system 100 is schematically depicted. The pathway cleaning system 100 includes a vehicle 110 and a magnetic pathway cleaning assembly 120 comprising a magnet 122 (FIGS. 3 and 4) for attracting and accumulating magnetic debris and a magnet sweeper 140 (FIGS. 3 and 4) for removing magnetic debris from the magnet 122. In some embodiments, the magnetic pathway cleaning assembly 120 may be coupled to the vehicle 110, which includes a vehicle frame 112 and a plurality of wheels 114 (e.g., casters) coupled to an underside 115 (FIGS. 3 and 4) of the vehicle frame 112. For example, as depicted in FIGS. 1 and 2, the vehicle 110 may comprise two wheels 114 positioned in alignment in the lateral direction on a first side 111 of the vehicle frame 112 and two wheels 114 positioned in alignment in the lateral direction on a second side 113 of the vehicle frame 112. The vehicle frame 112 further comprises a front end 118, a rear end 119, and a support surface 116. In some embodiments, the support surface 116 may be used to carry cargo.

As depicted in FIG. 2, the pathway cleaning system 100 may further comprise an adjacent vehicle 110' positioned on the vehicle pathway 104 adjacent the vehicle 110, for example, adjacent in the longitudinal direction. In this embodiment, the adjacent vehicle 110' may comprise substantially the same components as the vehicle 110, for example, the adjacent vehicle 110' may comprise a vehicle frame 112', a plurality of wheels 114' coupled to an underside 115' of the vehicle frame 112' on both a first side 111' and a second side 113' of the vehicle frame 112', front and rear ends 118', 119' and a support surface 116', as described above with respect to the vehicle 110.

Figure 3:
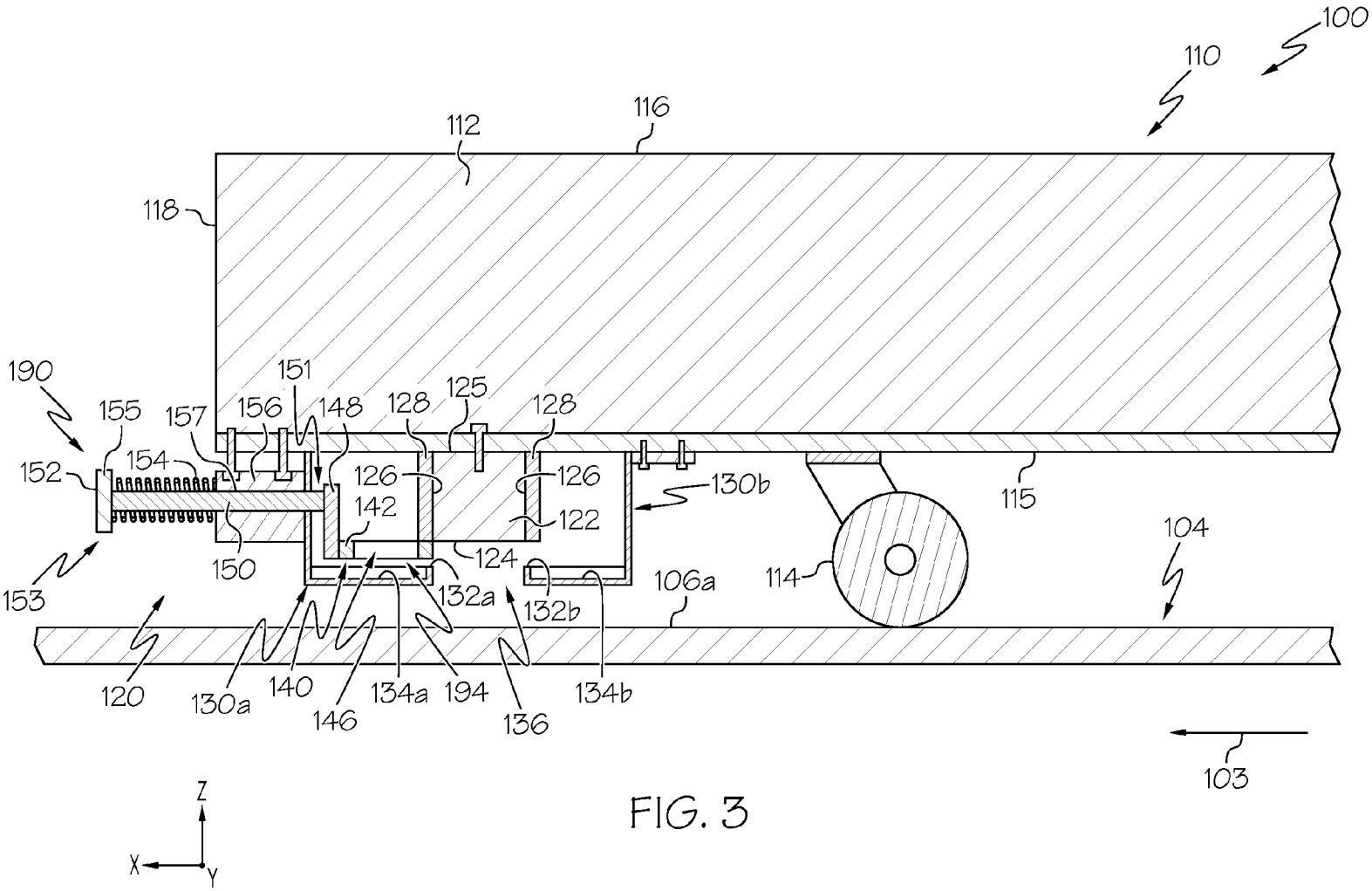
FIG. 3 depicts a schematic section view along line 3-3 of FIG. 1 according to one or more embodiments described herein.
Figure 4:
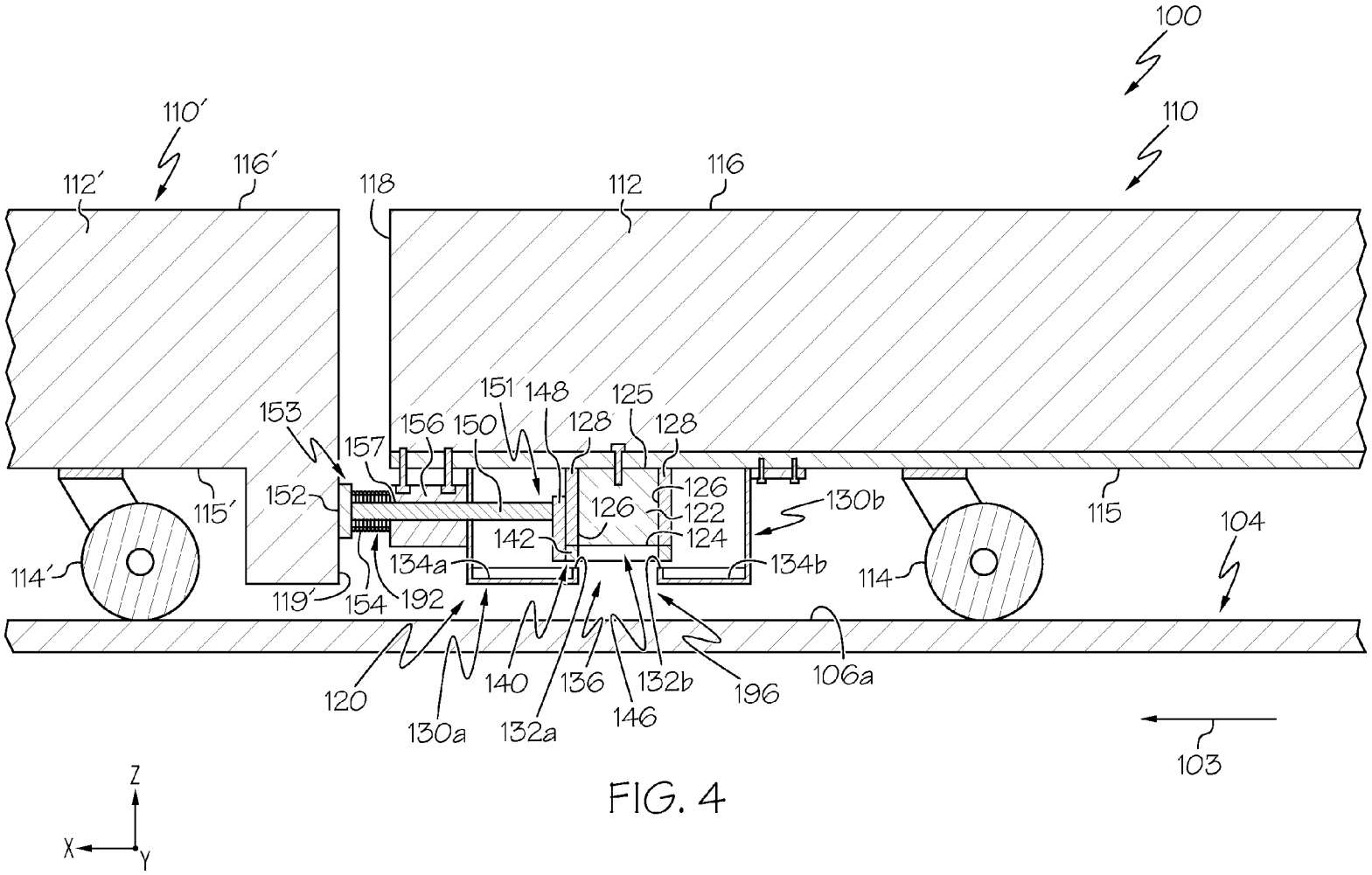
FIG. 4 depicts a schematic section view along line 4-4 of FIG. 2 according to one or more embodiments described herein.

In some embodiments, the vehicles 110, 110' may comprise conveyor skillets configured to transport cargo throughout a facility (e.g., a factory, a warehouse, or the like). The vehicles 110, 110' may travel along a vehicle pathway 104 in a vehicle travelling direction 103 along a facility floor 102. As also depicted in FIGS. 3 and 4, the vehicle pathway 104 may comprise first and second guide rails 106*a*, 106*b* raised in a vertical direction with respect to the facility floor 102. In some embodiments, the wheels 114, 114' of the vehicles 110, 110' are engageable with the first and second guide rails 106*a*, 106*b*. This allows the vehicles 110, 110' to follow the guide rails 106*a*, 106*b* when the vehicles 110, 110' are propelled, for example, using a friction drive system, a self-propelling system, or the like. While conveyor skillets are referenced herein, it should be understood that the pathway cleaning system 100 may comprise any vehicle, or alternatively any device, that traverses the facility floor 102 or other area that may accumulate magnetic debris. Further, it should be understood that the vehicle pathway 104 may comprise any path along the facility floor 102 or other area that the vehicle 110 may traverse.

Referring again to FIGS. 1-4, one or more magnetic pathway cleaning assemblies 120 are coupled to the vehicle 110, for example, to the underside 115 of the vehicle frame 112 such that a portion of each magnetic pathway cleaning assembly 120 extends beyond the vehicle frame, for example in the longitudinal direction, beyond the front end 118 or rear end 119, or in the lateral direction, beyond the first side 111 or second side 113. In some embodiments, magnetic pathway cleaning assemblies 120 may be positioned on the first side 111 of the vehicle frame 112, the second side 111 of the vehicle frame 112, or both sides of the vehicle frame 112. In some embodiments, the magnetic pathway cleaning assembly 120 may be positioned in lateral alignment with one or more wheels 114. Positioning the magnetic pathway cleaning assemblies 120 on both the first and second sides 111, 113 of the vehicle frame 112 allows the magnetic pathway cleaning assemblies 120 to remove magnetic debris from the first and second guide rails 106*a*, 106*b* as the vehicle 110 traverses the vehicle pathway 104. Alternatively, a single magnetic pathway cleaning assembly 120 may be configured to remove magnetic debris from both the first and second guide rails 106*a*, 106*b*.

Referring now to FIGS. 3 and 4, the magnetic pathway cleaning assembly 120 comprises a magnet 122. The magnet 122 includes a vehicle facing surface 125, a pathway facing surface 124, and one or more side surfaces 126 extending between the vehicle facing surface 125 and the pathway facing surface 124. In operation, the magnet 122 produces a magnetic attractive force which attracts magnetic debris positioned near the magnet 122, for example within a threshold distance from the magnet 122, (e.g., within about 60 cm or less). The magnetic debris may accumulate on the pathway facing surface 124 of the magnet 122 and in some embodiments, on the side surfaces 126 of the magnet 122.

As depicted in FIGS. 3 and 4, the magnetic pathway cleaning assembly 120 may be coupled to the vehicle 110. For example, the vehicle facing surface 125 of the magnet 122 may be coupled to the underside 115 of the vehicle frame 112 such that the pathway facing surface 124 faces the vehicle pathway 104 when the vehicle 110 is positioned on the vehicle pathway 104. The magnet 122 may be coupled to the underside 115 of the vehicle frame 112. In some embodiments, the magnet 122 may be positioned in alignment with at least one wheel 114 in the lateral direction and positioned in front of the wheel 114 in the vehicle travelling direction 103 such that magnet 122 traverses a portion of the vehicle pathway 104 and removes magnetic debris before the wheel 114 traverses the same portion of the vehicle pathway 104.

In other embodiments, the magnet 122 may be positioned out of alignment with at least one wheel 114 in the lateral direction. In this embodiment, the magnet 122 may still remove magnetic debris from the vehicle pathway 104 as the vehicle 110 traverses the vehicle pathway 104, for example, magnetic debris that are located within a threshold distance from the magnet 122, (e.g., within about 60 cm or less). Further, in some alternative embodiments, the magnet 122 may be positioned behind at least one wheel 114 in the vehicle travelling direction 103. In some embodiments, the magnet 122 may be directly coupled to the underside 115 of the vehicle frame 112, for example, using adhesive or one or more fasteners, such as bolts, screws, or the like. In other embodiments, the magnet 122 may be coupled to the underside 115 of the vehicle 110 using an intervening structure, such as a bracket or other support structure.

The magnet 122 may comprise a rare earth magnet (e.g., neodymium, neodymium-iron-boron, samarium-cobalt, or the like), an alnico magnet (e.g., aluminum, nickel, cobalt, or the like), or a ferrite magnet (e.g., strontium, iron, or the like). In alternative embodiments, the magnet 122 may comprise an electromagnet. Accordingly, it should be understood that any type of magnet is contemplated. Further, the magnet 122 may be rectangular in shape, cylindrical in shape, or the like. In some embodiments, the magnet 122 comprises a width extending in a lateral direction of between about 5 and 60 cm (e.g., 10, 20, 40 cm, or the like), a length extending in a longitudinal direction of between about 2 and 30 cm (e.g., 5, 10, 20 cm, or the like), and a height extending in a vertical direction of between about 2 and 30 cm (e.g., 5, 10, 20 cm, or the like). In some embodiments, the thickness of the magnet 122 in the lateral direction may be greater than or equal to a thickness of the one or more wheels 114 in the lateral direction. Further, while an individual magnet 122 is described herein, it should be understood that the magnetic pathway cleaning assembly 120 may comprise additional magnets 122. It should also be understood that increasing the size of the magnet 122 may increase the magnetic attractive force output by the magnet 122.

Referring still to FIGS. 3 and 4, the magnetic pathway cleaning assembly 120 may further comprise one or more magnetic shields 128 coupled to some or all of the side surfaces 126 of the magnet 122 using fasteners, adhesive, or the like. The one or more magnetic shields 128 may comprise a magnetic shielding material, such as plastic, polymer(s), or the like. The magnetic shields 128 may dampen or block the magnetic attractive force (e.g., the magnetic field) output through the side surfaces 126 of the magnet 122. For example, when one or more catch pans 130 are positioned adjacent the side surfaces 126 of the magnet 122, (e.g., catch pans 130 configured to store magnetic debris that have been removed from the vehicle pathway 104 by the magnet 122), the magnetic field output through the side surfaces 126 of the magnet 122 may be blocked or dampened by the magnetic shields 128. This reduces or eliminates the effect of the magnetic attractive force of the magnet 122 on any magnetic debris located in catch pans 130. In some embodiments, the magnetic shields 128 may comprise a thickness of about 0.5 to 15 cm extending outward from the side surfaces 126 of the magnet 122, for example, in the longitudinal or lateral direction.

Referring again to FIGS. 3 and 4, the magnetic pathway cleaning assembly 120 further comprises a magnet sweeper 140 having a sweeping portion 142 coupled to a translation shaft 150. The sweeping portion 142 is positioned beneath the pathway facing surface 124 of the magnet 122 in the vertical direction and may slide along the pathway facing surface 124 within a threshold distance (e.g., 5 cm or less) from the pathway facing surface 124 or in contact with the pathway facing surface 124. The sweeping portion 142 is movable between a retracted position 194 and an extended position 196. In the retracted position 194, the sweeping portion 142 is offset from the pathway facing surface 124 of the magnet 122, for example, in the longitudinal direction, as depicted in FIG. 3. In the extended position 196, the sweeping portion 142 is substantially aligned with the pathway facing surface 124, for example, in the longitudinal direction, as depicted in FIG. 4, such that the sweeping portion 142 is positioned directly beneath the pathway facing surface 124 of the magnet 122 in the vertical direction. In operation, sliding the sweeping portion 142 along the pathway facing surface 124 of the magnet 122 may remove magnetic debris accumulated on the pathway facing surface 124 of the magnet 122.

The sweeping portion 142 may comprise any non-magnetic material, such as stainless steel, aluminum, plastic, polymer(s), or the like. The non-magnetic material allows the sweeping portion 142 to slide freely along the pathway facing surface 124 of the magnet 122 without being affected by the magnetic attractive force of the magnet 122. The sweeping portion 142 may comprise longitudinal and lateral dimensions equal to or greater than the longitudinal and lateral dimensions of the pathway facing surface 124 (e.g., the length and the width of the pathway facing surface 124) such that movement of the sweeping portion 142 between the retracted position 194 and extended position 196 moves the sweeping portion 142 along the entire pathway facing surface 124.

Further, as depicted in FIGS. 3 and 4, the sweeping portion 142 may comprise a sweeping portion aperture 146 sized and configured such that at least a portion of the pathway facing surface 124 of the magnet 122 is exposed when the sweeping portion 142 is in the extended position 196. This allows magnetic debris to accumulate on the pathway facing surface 124 when the magnet sweeper 140 is in the extended position 196. Further, in embodiments where the magnet 122 includes one or more magnetic shields 128 coupled to the side surfaces 126 of the magnet 122, the sweeping portion aperture 146 may be sized and configured such that when the sweeping portion 142 is in the extended position 196, the sweeping portion 142 covers portions of the one or more of the magnetic shields 128 facing the vehicle pathway 104 and does not cover some or all of the pathway facing surface 124 of the magnet 122.

Referring still to FIGS. 3 and 4, the magnet sweeper 140 further comprises a translation shaft 150 having a first end 151 opposite a second end 153. The first end 151 may be coupled to the sweeping portion 142. The second end 153 extends beyond the vehicle 110. For example the second end 153 may extend beyond the front end 118 of the vehicle frame 112 in the longitudinal direction, as also depicted in FIGS. 1 and 2. Alternatively, the second end may extend beyond the rear end 119 of the vehicle frame 112 in the longitudinal direction, or extend beyond the first side 111 or second side 113 of the vehicle frame 112 in the lateral direction. Further, the second end 153 terminates at a contact surface 152. In some embodiments, the second end 153 comprises a shaft head 155 that is larger than the translation shaft 150 in one or both of the lateral or vertical directions. For example, a diameter of the shaft head 155 may be larger than a diameter of the translation shaft 150. When the translation shaft 150 comprises the shaft head 155, the contact surface 152 is located on the shaft head 155. In operation, the contact surface 152 provides an actuation surface such that force applied to the contact surface 152 moves the translation shaft 150, which moves the sweeping portion 142 along the pathway facing surface 124 of the magnet 122.

In some embodiments, as depicted in FIGS. 3 and 4, the magnet sweeper 140 may also comprise an extending portion 148 positioned between and coupled to both the sweeping portion 142 and the first end 151 of the translation shaft 150. In some embodiments, the first end 151 of the translation shaft 150 may be coupled to the extending portion 148 at a location offset from the sweeping portion 142, for example, in the vertical direction. Further, the extending portion 148 may provide a positive stop during operation of the magnet sweeper 140. For example, when the sweeping portion 142 is moved into the extended position 196, the extending portion 148 may contact an individual magnetic shield 128 (e.g., the magnetic shield 128 positioned between the extending portion 148 and the magnet 122) when the sweeping portion 142 reaches the extended position 196. In alternative embodiments not comprising the extending portion 148, the first end 151 of the translation shaft 150 may be directly coupled to the sweeping portion 142.

Referring still to FIGS. 3 and 4, the magnetic pathway cleaning assembly 120 may further comprise a shaft bracket 156 coupled to the underside 115 of the vehicle frame 112, for example, at a longitudinal position in front of the magnet 122 with respect to the vehicle travelling direction 103. The shaft bracket 156 may comprise an opening 157, such as a through-bore or the like. The translation shaft 150 may extend through the opening 157, coupling the translation shaft 150 to the vehicle 110. In some embodiments, the opening 157 of the shaft bracket 156 includes one or more bearings to reduce friction between the translation shaft 150 and the shaft bracket 156. Further, a lubricant may be positioned within the opening 157 of the shaft bracket 156 to reduce friction.

Referring again to FIGS. 1-4, the magnetic pathway cleaning assembly 120 further comprises a spring 154, for example, a compression spring, a tension spring, or the like. The spring 154 is engaged with the translation shaft 150 and biases the second end 153 of the translation shaft 150 beyond the vehicle frame 112, for example, in the longitudinal direction or the lateral direction. In some embodiments, the spring 154 may comprise a compression spring that encircles the translation shaft 150 and extends between the shaft head 155 and the shaft bracket 156, such that the shaft head 155 and the shaft bracket 156 may abut opposite ends of the spring 154. In embodiments in which the spring comprises a compression spring, the spring 154 comprises a decompressed position 190, as depicted in FIGS. 1 and 3, and a compressed position 192, as depicted in FIGS. 2 and 4. In operation, the spring 154 comprising a compression spring is biased into the decompressed position 190 and is actuatable into the compressed position 192, for example, when force is applied to the contact surface 152 of the translation shaft 150.

Referring still to embodiments comprising a compression spring, in the decompressed position 190, the spring 154 biases the shaft head 155 beyond the vehicle frame 112, for example, beyond the front end 118 of the vehicle frame 112 in the longitudinal direction, which biases the sweeping portion 142 into the retracted position 194. In operation, the spring 154 may be actuated into the compressed position 192 by applying a force to the contact surface 152 to move the shaft head 155 toward the vehicle frame 112, which compresses the spring 154 and moves the sweeping portion 142 along the pathway facing surface 124 of the magnet 122 into the extended position 196 or into a position along the pathway facing surface 124 between the retracted position 194 and the extended position 196.

In other embodiments, the spring 154 may comprise a tension spring positioned between the shaft bracket 156 and the sweeping portion 142, for example, engaged with the shaft bracket 156 and one or more of the first end 151 of the translation shaft 150, the extending portion 148, or the sweeping portion 142. The spring 154 comprising a tension spring biases the sweeping portion 142 into the retracted position 194 and biases the second end 153 of the translation shaft 150 into a position beyond the vehicle frame 112, for example, beyond the front end 118 of the vehicle frame 112 in the longitudinal direction. Alternatively, the spring 154 comprising a tension spring may be coupled to and may extend between the first end 151 of the translation shaft 150 and one or both of the extending portion 148 and the sweeping portion 142. In operation, the spring 154 comprising a tension spring is biased into a compressed positioned and is actuatable into a decompressed position, for example, when force is applied to the contact surface 152 of the translation shaft 150. In yet other embodiments, the spring 154 may be positioned within the translation shaft 150 or engaged with the translation shaft 150 using any exemplary spring coupling method. Further, in some embodiments, the magnetic pathway cleaning assembly 120 may comprise both a compression spring and a tension spring, for example, positioned on opposite sides of the shaft bracket 156.

Referring again to FIGS. 3 and 4, the magnetic pathway cleaning assembly 120 further comprises one or more catch pans 130 coupled to the underside 115 of the vehicle frame 112. The one or more catch pans 130 may comprise first and second catch pans 130*a*, 130*b* offset from the magnet 122, for example, in the longitudinal direction or in the lateral direction. As depicted in FIGS. 3 and 4, the first catch pan 130*a* may be longitudinally offset in front of the magnet 122 in the vehicle travelling direction 103 and the second catch pan 130*b* may be longitudinally offset behind the magnet 122 in the vehicle travelling direction 103. Further, an opening 136 extends between the first and second catch pans 130*a*, 130*b*, such that the magnet 122 is aligned with the opening 136 in the longitudinal direction and above the opening in the vertical direction. In operation, the opening 136 allows the magnet 122 to attract magnetic debris without the first and second catch pans 130*a*, 130*b* obstructing the magnet 122.

As depicted in FIGS. 3 and 4, the first and second catch pans 130*a*, 130*b* further comprise debris receptacles 134*a*, 134*b*, respectively. The first and second debris receptacles 134*a*, 134*b* are positioned beneath the pathway facing surface 124 of the magnet 122 in the vertical direction. In operation, the debris receptacles 134*a*, 134*b* provide a storage location for accumulated magnetic debris that are removed from the pathway facing surface 124 of the magnet 122 by the sweeping portion 142 of the magnet sweeper 140. Further, when one or more magnetic shields 128 are coupled to the side surfaces 126 of the magnet 122, the magnetic field output through the side surfaces 126 of the magnet 122 may be blocked or dampened, thus reducing or eliminating the effect of the magnetic attractive force of the magnet 122 on any magnetic debris located in debris receptacles 134*a*, 134*b*.

Referring still to FIGS. 3 and 4, the first and second catch pans 130*a*, 130*b* may further comprise lip portions 132*a*, 132*b* positioned along one or more edges of the debris receptacles 134*a*, 134*b*. The lip portions 132*a*, 132*b* extend from the debris receptacles 134*a*, 134*b* toward the underside 115 of the vehicle 110 in the vertical direction. The lip portions 132*a*, 132*b* extend in the vertical direction to a position beneath the pathway facing surface 124 of the magnet 122 such that the sweeping portion 142 may slide along the pathway facing surface 124 of the magnet 122 without contacting the lip portions 132*a*, 132*b*. In operation, the lip portions 132*a*, 132*b* provide the debris receptacles 134*a*, 134*b* with a barrier to prevent accumulated magnetic debris from exiting the debris receptacles 134*a*, 134*b*, for example, when the vehicle 110 traverses the vehicle pathway 104.

Operation of the magnetic pathway cleaning assembly 120 will now be discussed with reference to FIGS. 1-4. As discussed previously, the magnetic pathway cleaning assembly 120 may be coupled to the underside 115 of the vehicle frame 112, for example, at a location in front of at least one wheel 114 in the vehicle travelling direction 103. In operation, the vehicle 110 may traverse the vehicle pathway 104, for example, along the first and second guide rails 106*a*, 106*b*, in the vehicle travelling direction 103. As the vehicle 110 traverses the vehicle pathway 104, the spring 154 (e.g., a compression spring in this described embodiment) biases the contact surface 152 of the translation shaft 150 the vehicle frame 112 and biases the sweeping portion 142 of the magnet sweeper 140 into the retracted position 194. In the retracted position 194 the sweeping portion 142 is offset from the pathway facing surface 124 of the magnet 122 in the longitudinal direction such that the space between the pathway facing surface 124 and the vehicle pathway 104 is unobstructed.

As the vehicle 110 traverses the vehicle pathway 104, the magnet 122 attracts and removes magnetic debris located along the vehicle pathway 104. For example, the magnet 122 may attract and remove magnetic debris positioned on or near the first and/or second guide rail 106*a*, 106*b*, for example or within a threshold distance (e.g., 60 cm or less) from the magnet 122. The magnetic debris removed from the vehicle pathway 104 accumulate on the pathway facing surface 124 of the magnet 122. During operation of the vehicle 110, the magnet sweeper 140 may be actuated by applying a force to the contact surface 152 of the translation shaft 150. For example, the contact surface 152 may contact the adjacent vehicle 110' or another surface. This force may compress the spring 154 and slide the sweeping portion 142 along the pathway facing surface 124 of the magnet 122, from the retracted position 194 to the extended position 196 or to a longitudinal position between the retracted position 194 and the extended position 196. Sliding the sweeping portion 142 across the pathway facing surface 124 of the magnet 122 into the extended position 196 may push the accumulated magnetic debris into the one or more catch pans 130, for example, into the second catch pan 130*b*.

Once the sweeping portion 142 is actuated into the extended position 196, the force applied to the contact surface 152 may be maintained such that the sweeping portion 142 remains in the extended position 196. In the extended position, the sweeping portion aperture 146 of the sweeping portion 142 does not fully obstruct the pathway facing surface 124, allowing the pathway facing surface 124 to remain exposed such that the pathway facing surface 124 may attract and accumulate magnetic debris. Once the force is removed from the contact surface 152, the spring 154 decompresses, moving the sweeping portion 142 along the pathway facing surface 124 of the magnet from the extended position 196 back to the retracted position 194. This movement pushes magnetic debris accumulated on the pathway facing surface 124 within the sweeping portion aperture 146 into one of the catch pans 130, for example, into the first catch pan 130*a*.

In some embodiments, as depicted in FIGS. 2 and 4, contact between the adjacent vehicle 110' and the contact surface 152 of the translation shaft 150 may actuate the magnet sweeper 140. For example, the rear end 119' of the adjacent vehicle 110' may contact the contact surface 152, compressing the spring 154 and sliding the sweeping portion 142 from the retracted position 194, along the pathway facing surface 124 of the magnet 122, into the extended position 196. In some embodiments, the rear end 119' of the adjacent vehicle 110' may further comprise a bracket or other structure sized and positioned to contact the contact surface 152. In this embodiment, the vehicles 110, 110' may traverse a portion of the vehicle pathway 104 in contact such that the sweeping portion 142 remains in the extended position 196 while the vehicles 110, 110' traverse the portion of the vehicle pathway 104. After traversing the portion of the vehicle pathway 104 in contact, the vehicles 110, 110' may separate, allowing the spring 154 to move the sweeping portion 142 along the pathway facing surface 124 into the retracted position 194. This contact between the vehicles 110, 110' may be repeated multiple times as the vehicles 110, 110' traverse the vehicle pathway 104.

In alternative embodiments, other methods of actuating the sweeping portion 142 of the magnet sweeper 140 are contemplated. For example, the sweeping portion 142 of the magnet sweeper 140 may be actuated by contact between the contact surface 152 and a stationary object, such as a wall, a docking station, a loading/unloading station, or the like. Further, a user may manually actuate the magnet sweeper 140, for example, by pressing the contact surface 152. In yet other embodiments, the sweeping portion 142 of the magnet sweeper 140 may be actuated using an automated system configured to apply force to the contact surface 152 intermittently or in response to a received signal, for example, a communicative signal.

It should now be understood that the above described pathway cleaning systems include a magnetic pathway cleaning assembly coupled to vehicle, for example, a conveyor skillet, configured to travel along a vehicle pathway. The magnetic pathway cleaning assembly includes a magnet for attracting magnetic debris located on the vehicle pathway, a magnet sweeper including a sweeping portion configured to slide along a pathway facing surface of the magnet to remove debris accumulated by the magnet, and one or more catch pans positioned offset from the magnet such that the magnet sweeper may push the accumulated magnetic debris into the one or more catch pans. The magnet sweeper also includes a translation shaft coupled to the sweeping portion. A spring biases the sweeping portion into a retracted position, offset from the pathway facing surface of the magnet. In operation, when force is applied to the translation shaft, the sweeping portion slides along the pathway facing surface of the magnet to push any debris accumulated by the magnet into the one or more catch pans and when force is removed from the translation shaft, the spring returns the magnet sweeper into the retracted position offset from the pathway facing surface of the magnet. By removing magnetic debris from the vehicle pathway, vehicle damage and vehicle pathway damage (e.g., guide rail damage) may be reduced. Further, disruptions to the operation of the vehicle caused by contact with magnetic debris may also be reduced.

Having described the disclosure in detail and by reference to specific embodiments thereof, it will be apparent that modifications and variations are possible without departing from the scope of the disclosure defined in the appended claims. More specifically, although some aspects of the present disclosure are identified herein as preferred or particularly advantageous, it is contemplated that the present disclosure is not necessarily limited to these preferred aspects of the disclosure.

Directional terms used herein—for example widthwise, lengthwise, vertical, up, down, right, left, front, back, top, bottom, upper, lower—are made only to supply directional context. For example, the terms "extending vertically" or "extending generally vertically" are not meant to exclude a vertically and horizontally extending component.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A magnetic pathway cleaning assembly comprising:
a magnet comprising a pathway facing surface;
a magnet sweeper comprising:
a sweeping portion slidably engageable with the pathway facing surface of the magnet; and
a translation shaft comprising a first end opposite a second end, wherein the first end is coupled to the sweeping portion and the second end terminates at a contact surface; and
a spring engaged with the translation shaft and biasing the magnet sweeper into a retracted position offset from the pathway facing surface of the magnet;
wherein the magnet sweeper is actuatable such that a force applied to the contact surface of the translation shaft moves the sweeping portion along the pathway facing surface of the magnet.

2. The magnetic pathway cleaning assembly of claim 1, further comprising one or more catch pans positioned offset from the magnet, wherein each catch pan comprises a receptacle portion positioned beneath the pathway facing surface of the magnet.

3. The magnetic pathway cleaning assembly of claim 1, wherein the sweeping portion is slidable along the pathway facing surface of the magnet between the retracted position and an extended position, wherein in the extended position the sweeping portion is positioned directly beneath the pathway facing surface of the magnet.

4. The magnetic pathway cleaning assembly of claim 3, wherein the sweeping portion further comprises a sweeping portion aperture sized such that at least a portion of the pathway facing surface of the magnet is exposed when the sweeping portion is in the extended position.

5. The magnetic pathway cleaning assembly of claim 1, wherein the second end of the translation shaft comprises a shaft head, wherein the contact surface is positioned on the shaft head and the shaft head has a diameter that is larger than a diameter of the translation shaft.

6. The magnetic pathway cleaning assembly of claim 1, wherein the spring encircles the translation shaft.

7. The magnetic pathway cleaning assembly of claim 1, further comprising one or more magnetic shields coupled to one or more side surfaces of the magnet.

8. A vehicle comprising:
a vehicle frame and a wheel coupled to an underside of the vehicle frame;
a magnetic pathway cleaning assembly comprising:
a magnet coupled to the underside of the vehicle frame, the magnet comprising a pathway facing surface;
a magnet sweeper comprising:
a sweeping portion slidably engageable with the pathway facing surface of the magnet; and
a translation shaft mounted to the underside of the vehicle frame and slidable with respect to the vehicle frame, the translation shaft comprising a first end opposite a second end, wherein the first end is coupled to the sweeping portion and the second end terminates at a contact surface extending beyond the vehicle frame; and
a spring engaged with the translation shaft such that the spring biases the magnet sweeper into a retracted position offset from the pathway facing surface of the magnet;
wherein the magnet sweeper is actuatable such that a force applied to the contact surface of the translation shaft moves the sweeping portion along the pathway facing surface of the magnet.

9. The vehicle of claim 8, further comprising one or more catch pans coupled to the underside of the vehicle frame and positioned offset from the magnet, wherein each catch pan comprises a receptacle portion positioned beneath the pathway facing surface of the magnet.

10. The vehicle of claim 8, further comprising a shaft bracket coupled to the underside of the vehicle frame, wherein the translation shaft extends through the shaft bracket.

11. The vehicle of claim 8, wherein the spring encircles the translation shaft and biases the contact surface of the translation shaft such that the contact surface of the translation shaft extends beyond the vehicle frame.

12. The vehicle of claim 8, wherein the magnet is coupled to the underside of the vehicle frame at a position offset from the wheel in a longitudinal direction and aligned with the wheel in a lateral direction.

13. The vehicle of claim 8, wherein the magnet sweeper further comprises an extending portion positioned between and coupled to both the translation shaft and the sweeping portion, such that the translation shaft and the sweeping portion are offset.

14. The vehicle of claim 8, wherein the sweeping portion is slidable along the pathway facing surface of the magnet between the retracted position and an extended position, wherein in the extended position the sweeping portion is positioned directly beneath the pathway facing surface of the magnet.

15. The vehicle of claim 14, wherein the sweeping portion further comprises a sweeping portion aperture sized such that at least a portion of the pathway facing surface of the magnet is exposed when the sweeping portion in the extended position.

16. The vehicle of claim 8, further comprising one or more magnetic shields coupled to one or more side surfaces of the magnet.

17. A method of cleaning a vehicle pathway, the method comprising:
traversing a vehicle along a portion of a vehicle pathway, the vehicle comprising a vehicle frame, a wheel coupled to an underside of the vehicle frame, and a magnetic pathway cleaning assembly coupled to the underside of the vehicle frame, the magnetic pathway cleaning assembly comprising:
a magnet comprising a pathway facing surface;
a magnet sweeper comprising:
a sweeping portion slidably engageable with the pathway facing surface of the magnet; and
a translation shaft mounted to the underside of the vehicle frame and slidable with respect to the vehicle frame, the translation shaft comprising a first end opposite a second end, wherein the first end is coupled to the sweeping portion and the second end terminates at a contact surface positioned beyond the vehicle frame; and
a spring engaged with the translation shaft such that the spring biases the sweeping portion into a retracted position offset from the pathway facing surface of the magnet;
wherein the sweeping portion is positioned in the retracted position; and
applying a force to the contact surface of the translation shaft such that the sweeping portion slides along the pathway facing surface of the magnet.

18. The method of cleaning a vehicle pathway of claim 17, wherein the sweeping portion is slidable along the pathway facing surface of the magnet between the retracted position and an extended position, wherein in the extended position the sweeping portion is positioned directly beneath the pathway facing surface of the magnet.

19. The method of cleaning a vehicle pathway of claim 18, the method further comprising:

applying a force to the contact surface of the translation shaft such that the sweeping portion slides along the pathway facing surface of the magnet into the extended position; and traversing the vehicle along a second portion of the vehicle pathway with the sweeping portion in the extended position.

20. The method of cleaning a vehicle pathway of claim 19, the method further comprising removing a force from the contact surface of the translation shaft such that the sweeping portion slides along the pathway facing surface of the magnet into the retracted position.

* * * * *